US007767633B2

(12) United States Patent
van Dam

(10) Patent No.: US 7,767,633 B2
(45) Date of Patent: Aug. 3, 2010

(54) LOW SULFUR AND LOW PHOSPHORUS HEAVY DUTY DIESEL ENGINE LUBRICATING OIL COMPOSITION

(75) Inventor: Willem van Dam, Novato, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 935 days.

(21) Appl. No.: 11/274,633

(22) Filed: Nov. 14, 2005

(65) Prior Publication Data

US 2007/0111905 A1 May 17, 2007

(51) Int. Cl.
*C10M 135/36* (2006.01)
*C10M 141/10* (2006.01)
*C10M 135/18* (2006.01)

(52) U.S. Cl. ..... 508/273; 508/335; 508/363

(58) Field of Classification Search ..... 508/273, 508/335, 363

See application file for complete search history.

(56) References Cited

U.S. PATENT DOCUMENTS

| | | | | |
|---|---|---|---|---|
| 4,623,473 | A | 11/1986 | Davis et al. | |
| 4,842,755 | A | 6/1989 | Dunn | |
| 4,859,353 | A | 8/1989 | Colclough | |
| 4,990,271 | A * | 2/1991 | Francis | 508/445 |
| 6,159,911 | A | 12/2000 | Katafuchi | |
| 6,300,291 | B1 * | 10/2001 | Hartley et al. | 508/363 |
| 6,408,812 | B1 | 6/2002 | Chamberlin, III et al. | |
| 6,588,393 | B2 | 7/2003 | Chamberlin, III et al. | |
| 6,723,685 | B2 | 4/2004 | Hartley et al. | |
| 6,730,638 | B2 | 5/2004 | Farng et al. | |
| 6,777,378 | B2 | 8/2004 | Abraham et al. | |
| 6,852,679 | B2 | 2/2005 | Hartley et al. | |
| 2003/0096716 | A1 * | 5/2003 | Locke et al. | 508/525 |
| 2003/0148895 | A1 | 8/2003 | Robson et al. | |
| 2003/0158048 | A1 | 8/2003 | Farng et al. | |
| 2003/0182847 | A1 | 10/2003 | Katafuchi | |
| 2004/0077506 | A1 | 4/2004 | Arrowsmith et al. | |
| 2004/0102335 | A1 | 5/2004 | Carrick et al. | |
| 2004/0127371 | A1 | 7/2004 | Arrowsmith et al. | |
| 2004/0176257 | A1 * | 9/2004 | Boffa et al. | 508/156 |
| 2005/0026792 | A1 | 2/2005 | Cartwright | |
| 2005/0043191 | A1 | 2/2005 | Farng et al. | |
| 2005/0137096 | A1 | 6/2005 | Yoon et al. | |

FOREIGN PATENT DOCUMENTS

| | | | |
|---|---|---|---|
| EP | 0 556 404 | A1 | 8/1992 |
| EP | 1 041 134 | A2 | 10/2000 |
| EP | 1 498 471 | A2 | 1/2005 |
| EP | 1 533 362 | A1 | 5/2005 |

* cited by examiner

*Primary Examiner*—Walter D Griffin
*Assistant Examiner*—Frank C Campanell
(74) *Attorney, Agent, or Firm*—Sarita R. Kelley

(57) ABSTRACT

The present invention is directed to a low sulfur and low phosphorus heavy duty diesel engine lubricating oil composition comprising (a) a major amount of an oil of lubricating viscosity and (b) one or more dispersants (c) one or more anti-oxidants and (d) one or more ash-containing detergents, wherein the lubricating oil composition is essentially free of zinc di-alkyl di-thiophosphates and contains no more than 0.175 weight percent sulfur and provided the lubricating oil composition does not contain alkylated and non-alkylated aromatic amines and tri-nuclear molybdenum compounds. The present invention is also directed to a low sulfur and low phosphorus heavy duty diesel engine lubricating oil composition comprising (a) an oil of lubricating viscosity (b) a borated dispersant and a non-borated dispersant (c) a molybdenum anti-oxidant and a phenolic anti-oxidant and (d) a low overbased calcium sulfonate and a high overbased calcium phenate, wherein the lubricating oil composition is essentially free of zinc di-alkyl di-thiophosphates and contains no more than 0.175 weight percent sulfur and provided the lubricating oil composition does not contain alkylated and non-alkylated aromatic amines and tri-nuclear molybdenum compounds. The present invention is also directed to method for lubricating a heavy duty diesel engines, which comprises lubricating the engine with a low sulfur and low phosphorus heavy duty diesel engine lubricating oil compositions of the present invention.

27 Claims, No Drawings

LOW SULFUR AND LOW PHOSPHORUS HEAVY DUTY DIESEL ENGINE LUBRICATING OIL COMPOSITION

FIELD OF THE INVENTION

The present invention is directed to a low sulfur and low phosphorus heavy duty diesel engine lubricating oil composition comprising (a) a major amount of an oil of lubricating viscosity and (b) one or more dispersants (c) one or more anti-oxidants and (d) one or more ash-containing detergents, wherein the lubricating oil composition is essentially free of zinc di-alkyl di-thiophosphates and contains no more than 0.175 weight percent sulfur and provided the lubricating oil composition does not contain alkylated and non-alkylated aromatic amines and tri-nuclear molybdenum compounds. The present invention is also directed to a low sulfur and low phosphorus heavy duty diesel engine lubricating oil composition comprising (a) an oil of lubricating viscosity (b) a borated dispersant and a non-borated dispersant (c) a molybdenum anti-oxidant and a phenolic anti-oxidant and (d) a low overbased calcium sulfonate a high overbased calcium phenate, wherein the lubricating oil composition is essentially free of zinc di-alkyl di-thiophosphates and contains no more than 0.175 weight percent sulfur and provided the lubricating oil composition does not contain alkylated and non-alkylated aromatic amines and tri-nuclear molybdenum compounds. The present invention is also directed to method for lubricating a heavy duty diesel engines, which comprises lubricating the engine with a low sulfur and low phosphorus heavy duty diesel engine lubricating oil compositions of the present invention.

BACKGROUND OF THE INVENTION

Future diesel engines will be equipped with exhaust gas after-treatment systems to allow them to comply with future emission legislation. Some of these systems have proven to be sensitive to the combustion products of the fuel and lubricant used in the engine. Certain types of systems are sensitive to phosphorus coming from the lubricant, others are sensitive to sulfur coming from both fuel and lubricant, yet others are sensitive to sulfated ash resulting from the combustion of fuel and lubricant. In order to ensure the durability of these different types of after-treatment systems, special lubricants are being developed that feature low levels of sulfated ash, sulfur and phosphorus. The most common of these lubricants provide low sulfated ash levels with reduced sulfur and phosphorus. Less common are low or no phosphorus lubricants that use specific, mostly sulfur or molybdenum based, zinc di-alkyl di-thiophosphate-replacement additives.

The guidelines for low emission diesel lubricants that will be commercialized in 2007 and 2008 are: (1) the sulfated ash must be equal to or lower than 1.0 weight percent for diesel engine lubricating oils and equal to or lower than 0.5 weight percent for passenger car diesel engine lubricating oils, (2) according to some engine builders, sulfur content of the lubricating oil must be less than 0.2 weight percent, while other engine builders allow up to a maximum of 0.4 weight percent, and (3) some engine builders require the maximum amount of phosphorus to be 0.08 weight percent, while other engine builders allow up to 0.12 weight percent of phosphorus.

The first generations of low emission diesel lubricating oils were formulated to meet the above guidelines using low levels of detergent and zinc di-alkyl di-thiophosphate. However, the expectation is that at some point in the future, the maximum sulfur and phosphorus content may be further reduced beyond where we expect the industry to go between now and 2010. Lubricating oils with no phosphorus were expected to provide no wear protection whatsoever. In an attempt to explore the boundaries of the performance envelope, we developed experimental lubricating oil formulations of the present invention containing essentially no phosphorus. Wear measurements were performed with these experimental lubricating oils in a heavy duty diesel engine and the results showed unexpectedly low cylinder liner wear levels.

A number of patents and patent applications have discussed methods for reducing emissions using low sulfur and low phosphorus lubricating oil compositions, but none have disclosed a low sulfur and low phosphorus lubricating oil composition comprising (a) borated dispersant and anon-borated dispersant (b) a molybdenum anti-oxidant and a phenolic anti-oxidant and (c) a low overbased sulfonate and a high overbased sulfonate, which despite containing essentially no zinc di-alkyl di-thiophosphate provides significant reduction in wear.

U.S. Pat. No. 4,623,473 discloses sulfur containing oil-soluble compositions which are useful as lubricating oil additives, particularly in lubricants containing little or no phosphorus. In one embodiment, the compositions of the invention comprise (A) at least one metal salt of at least one dithiocarbamic acid and (B) at least one oil-soluble sulfurized Diels-Alder adduct. Such lubricating oil compositions exhibit improved oxidation-corrosion inhibiting properties, anti-wear properties, and/or extreme pressure properties. These lubricating oil compositions contains less than 0.1 weight percent phosphorus also exhibit good compatibility with nitrile seals.

U.S. Pat. No. 4,859,353 discloses sulfur-containing borate esters for use in lubricants appropriate to modern oil requirements with reduced or zero amounts of phosphorus and without the need for large amounts and/or expensive forms of anti-oxidant and additional anti-wear additives.

U.S. Pat. No. 4,990,271 discloses a lubricating oil composition which comprises a major amount of an oil of lubricating viscosity and a minor amount of an additive formed by contacting molybdenum hexacarboxyl with di-xanthogens of the formula $(ROCS_2)_2$. Moreover, the lubricant compositions of this invention do not include phosphorus.

U.S. Pat. No. 6,159,911 discloses a diesel engine oil composition containing a lube oil base and one or more metallic detergents-dispersants selected from among a perbasic alkaline earth metal sulfonate, phenolate and salicylate. The total phosphorus content of the composition is suppressed to 100 parts per million by weight or less, to thereby provide diesel engine oil compositions having oxidation stability and wear resistance.

U.S. Pat. No. 6,162,770 discloses an un-sulfurized, alkali metal-free, detergent-dispersant composition having from about 40% to 60% alkylphenol, from 10% to 40% alkaline earth alkylphenol, and from 20% to 40% alkaline earth single aromatic-ring alkylsalicylate. This composition may have an alkaline earth double aromatic-ring salicylates as long as the mole ratio of single-ring alkylsalicylate to double aromatic ring alkylsalicylate is at least 8:1.

U.S. Pat. Nos. 6,331,510 and 6,610,637 disclose a lubricant containing (a) a synthetic base oil composition having an overall kinematic viscosity of at least about $4.8\times10^{-6}$ $m^2/s$ (4.8 cSt) at 100° C. and a viscosity index of at least 110; (b) a dispersant-viscosity modifier; and (c) a sulfur-free functionalized hydrocarbyl-substituted phenol detergent provides improved valve train wear, with longer drain intervals, to heavy duty diesel engines.

U.S. Pat. No. 6,376,434 discloses a lube composition which is suitably used for diesel engines which exhaust large amounts of sulfur dioxides. The composition exhibits corrosion/wear preventive properties against sulfur dioxides. The lube composition includes a lube base oil, a component (A) which is a compound selected from a group consisting of overbased sulfonates of alkaline earth metal, overbased phenates of alkaline earth metals and overbased salicylates of alkaline earth metals, and a component (B) which is a bis-type succinimide compound.

U.S. Pat. Nos. 6,408,812 and 6,588,393 disclose a low sulfur consumable lubricating oil composition comprising a base oil, an acylated nitrogen-containing compound having a substituent of at least about 10 aliphatic carbon atoms; a sulfur content of about 5 to about 250 parts per million; said composition being characterized by the absence of an extreme-pressure additive comprised of metal and phosphorus.

U.S. Pat. No. 6,588,393 discloses a low-sulfur consumable lubricating oil composition comprising a base oil, an acylated nitrogen-containing compound having a substituents of at least 10 aliphatic carbon atoms, and a sulfur content of about 5 to about 250 ppm, such composition being characterized by the absence of an extreme pressure additive comprised of metal and phosphorus.

U.S. Pat. No. 6,723,685 discloses a lubricating oil composition comprising (a) an oil of lubricating viscosity having a viscosity index of at least 95; (b) at least one calcium detergent; (c) at least one oil-soluble molybdenum compound; (d) at least one organic ashless nitro-free friction modifier; and (e) at least one metal di-hydrocarbyl di-thiophosphate compound, the composition having a NOACK volatility of about 15 weight percent or less, from 0.05 to 0.6 weight percent calcium from the calcium detergent, molybdenum in an amount of at least 10 ppm from the molybdenum compound, and phosphorus from the metal di-hydrocarbyl di-thiophosphate compound in an amount up to about 0.1 weight percent.

U.S. Pat. No. 6,730,638 discloses a lubricating oil for internal combustion engines especially useful with fuels having less than 350 parts per million sulfur comprises a lubricating oil basestock, a boron-containing ashless dispersant, a molybdenum-containing friction reduction agent, a metal type detergent and zinc di-thiophosphate.

U.S. Pat. No. 6,777,378 discloses a lubricating oil composition comprising: (A) a base oil; (B) a molybdenum and sulfur-containing composition derived from a basic nitrogen-containing compound, a molybdenum compound and carbon disulfide; (C) a boron-containing compound; and (D) optionally a phosphorus-containing compound, provided the phosphorus content of the lubricating oil composition does not exceed about 0.1 weight percent.

U.S. Pat. No. 6,784,143 discloses the use of a minor amount of a detergent composition comprising one or more metal detergents which comprises metal salts of organic acids, wherein the detergent composition comprises more than 50 mole percent, based on the moles of the metal salts of organic acids in the detergent composition, of: (I) a metal salt of an aromatic carboxylic acid, or (II) a metal salt of a phenol, or (III) both a metal salt of an aromatic carboxylic acid and a metal salt of a phenol, in a lubricating oil composition for improving oxidation resistance of the lubricating oil composition, wherein the amount of phosphorus and sulfur in the oil composition is less than 0.09 mass % and at the most 0.5 mass % respectively, based on the mass of the oil composition. It has also been found that a detergent composition comprising more than 50 mole % of a metal salt of an aromatic carboxylic acid improves the reduction in wear in an engine.

U.S. Pat. No. 6,852,679 discloses a lubricating oil composition having less than 0.2 weight percent sulfur, less than 50 ppm chlorine, less than 50 ppm phosphorus, a NOACK volatility of 15 weight percent or less comprising an organo-molybdenum compound, an overbased calcium or magnesium salicylates, a dispersant and a supplemental antioxidant.

European Patent Application No. 92917678.2 (Publication No. EP 0 556 404 A2) discloses a lubricating oil composition prepared by compounding a base oil with a metal di-thiocarbamate and an oil-soluble amino compound. The composition contains scarcely any or no phosphorus and is excellent in wear resistance, extreme pressure properties, frictional characteristics, oxidation stability and coking resistance, thus being suitably usable as a lubricating oil for internal combustion engines of automobiles.

European Patent Application No. 00302646.5 (Publication No. EP 1 041 134 A1) discloses a lubricating oil composition which contains from about 50 to 1,000, preferably 50 to 500 parts per million of molybdenum from a molybdenum compound which is oil-soluble and substantially free of reactive sulfur, about 1,000 to 20,000, preferably 1,000 to 10,000 parts per million of a di-arylamine and 2,000 to 40,000 parts per million of a phenate. This combination of ingredients provides improved oxidation control and improved deposit control to the lubricating oil. This composition is particularly suitable for use as a crankcase lubricant.

European Patent Application No. 04016160.6 (Publication No. EP 1 498 471 A1) discloses an improved lubricating oil composition suitable for diesel engines comprising a major amount of at least one oil of lubricating viscosity and a minor amount of an alkylamine-alkylphosphate additive. The alkylamine-alkylphosphate additive comprises from at least 1.25 equivalents of alkylamine to 1.0 equivalents of alkylphosphate.

U.S. patent application Ser. No.10/344,696 (Publication No. US 2003/0182847 A1) discloses an additive used for a fuel oil or a lubricating oil composition for a diesel engine having a diesel particulate filter, and a fuel oil comprising the additive. The lubricating oil composition having a sulfated ash content of 1.0 weight percent or smaller, a sulfur content of 0.3 weight percent or smaller and a molybdenum content of 100 ppm or greater.

U.S. patent application Ser. No.10/277,295 (Publication No. US 2004/0077506 A1) discloses a lubricating oil composition having a total base number of at least about 8, comprising a major amount of oil of lubricating viscosity; an amount of one or more di-hydrocarbyl di-thiophosphate metal salt introducing into the lubricating oil composition no more than 0.06 weight percent of phosphorus; at least 1.2 weight percent of hindered phenol antioxidant; and boron and/or boron-containing compound or compounds in an amount providing the lubricating oil composition wit at least 200 ppm by weight of boron, all weight percentages being based on the total weight of the lubricating oil composition.

U.S. patent application Ser. No.10/649,572 (Publication No. US 2004/0127371 A1) discloses a lubricating oil composition for use in an internal combustion engine operated with a fuel having a sulfur content of less than 50 ppm, that contains a minor amount of at least one metal-containing detergent, which lubricating oil composition, when formulated for use in a diesel engine has a total ash content of less than 1.0 weight percent and when formulated for use in a gasoline engine has a total ash content of less than 0.7 weight percent.

U.S. patent application Ser. No.10/893,599 (Publication No. US 2005/0043191 A1) discloses a substantially zinc and phosphorus free lubricating oil meeting engine performance requirements contains an additive system containing metal detergents, at least one borated ashless dispersant, at least an amine anti-oxidant and a tri-nuclear molybdenum compound. The lubricant contains a minimum of 120 ppm boron and a minimum of 80 ppm molybdenum.

U.S. patent application Ser. No. 10/666,356 (Publication No. US 2005/0026792 A1) discloses a lubricating oil composition with very low phosphorus content, and having long life as evidenced by a reduction in viscosity increase, oxidation and nitration, comprises a major amount of a base oil of lubricating viscosity and a minor amount of a mixer of neutral and overbased metallic detergents, at least a zinc di-alkyl di-thiocarbamate anti-wear additive and at least a di-hydrocarboxylthiocarbamoyl.

U.S. patent application Ser. No.10/951,356 (Publication No. US 2005/0137096 A1) discloses an engine lubricant that is substantially free of zinc and phosphorus contains an anti-wear additive comprising borated 1,2-epoxy mixed polybutenes having an average carbon number in the range of $C_{20}$ to $C_{120}$.

SUMMARY OF THE INVENTION

The present invention is directed to a low sulfur and low phosphorus heavy duty diesel engine lubricating oil composition comprising (a) a major amount of an oil of lubricating viscosity and (b) one or more dispersants (c) one or more anti-oxidants and (d) one or more ash-containing detergents, wherein the lubricating oil composition is essentially free of zinc di-alkyl di-thiophosphates and contains no more than 0.175 weight percent sulfur and provided the lubricating oil composition does not contain alkylated and non-alkylated aromatic amines and tri-nuclear molybdenum compounds. The present invention is also directed to a low sulfur and low phosphorus heavy duty diesel engine lubricating oil composition comprising (a) an oil of lubricating viscosity (b) a borated dispersant and a non-borated dispersant (c) a molybdenum anti-oxidant and a phenolic anti-oxidant and (d) a low overbased calcium sulfonate a high overbased calcium phenate, wherein the lubricating oil composition is essentially free of zinc di-alkyl di-thiophosphates and contains no more than 0.175 weight percent sulfur and provided the lubricating oil composition does not contain alkylated and non-alkylated aromatic amines and tri-nuclear molybdenum compounds. The present invention is also directed to method for lubricating a heavy duty diesel engines, which comprises lubricating the engine with a low sulfur and low phosphorus heavy duty diesel engine lubricating oil compositions of the present invention.

Specifically, the present invention is directed to a low sulfur and low phosphorus heavy duty diesel engine lubricating oil composition comprising:

(a) a major amount of an oil of lubricating viscosity;
(b) one or more dispersants;
(c) one or more anti-oxidants, provided the anti-oxidant is not an amine anti-oxidant; and
(d) one or more ash-containing detergents;

wherein the lubricating oil composition is essentially free of zinc di-alkyl di-thiophosphates and contains no more than 0.175 weight percent sulfur and provided the lubricating oil composition does not contain alkylated and non-alkylated aromatic amines and tri-nuclear molybdenum compounds.

Preferably the one or more detergents in (d) in the above lubricating oil composition is not an overbased metal salicylate or an overbased metal carboxylate.

In the above lubricating oil composition of the present invention, preferably the concentration of the zinc di-alkyl di-thiophosphates is less than 0.2 weight percent based on the total weight of the lubricating oil composition. More preferably the concentration of the zinc di-alkyl di-thiophosphates is less than 0.1 weight percent based on the total weight of the lubricating oil composition, and most preferably the concentration of the zinc di-alkyl di-thiophosphates is less than 0.0 based on the total weight of the lubricating oil composition.

Preferably the sulfur content of the lubricating oil composition of the present invention is in the range of 0.0 weight percent to about 0.17 weight percent based on the total weight of the lubricating oil composition. More preferably the sulfur content of the lubricating oil composition of the present invention is in the range of 0.06 weight percent to about 0.165 weight percent based on the total weight of the lubricating oil composition. Most preferably the sulfur content of the lubricating oil composition of the present invention is in the range of 0.08 weight percent to about 0.16 weight percent based on the total weight of the lubricating oil composition.

Preferably the phosphorus content of the lubricating oil composition of the present invention is in the range of 0.0 weight percent to about 0.03 weight percent based on the total weight of the lubricating oil composition. More preferably the phosphorus content of the lubricating oil composition of the present invention is in the range of 0.0 weight percent to about 0.02 weight percent based on the total weight of the lubricating oil composition. Even more preferably the phosphorus content of the lubricating oil composition of the present invention is in the range of 0.0 weight percent to about 0.01 weight percent based on the total weight of the lubricating oil composition and most preferably it is 0.0.

Preferred dispersants that may be employed in the lubricating oil composition of the present invention are ashless dispersants. Examples of ashless dispersants are alkenyl succinimides and succinamides. These dispersants can be further modified by reaction with, for example, with boron or ethylene carbonate. Ester-based ashless dispersants derived from long chain hydrocarbon-substituted carboxylic acids and hydroxy compounds may also be employed. More preferred ashless dispersants are those derived from polyisobutenyl succinic anhydride.

Preferred examples of anti-oxidants employable in the lubricating oil of the present invention are esters of thiodicarboxylic acids, di-thiocarbamates, such as 15-methylenebis (di-butyl di-thiocarbamate), salts of di-thiophosphoric acids, alkyl or aryl phosphates. Molybdenum compounds, such as amine-molybdenum complex compound and molybdenum di-thiocarbamates may also be used as anti-oxidants and hindered phenols, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butylphenol), 4,4'-butylidene-bis(3-methyl-6-tert-butylphenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-5-methylene-bis(4-methyl-6-cyclohexylphenol), 2,6-di-tert-butyl-4-methylphenol, 2,6-di-tert-butyl4-ethylphenol, 2,4-dimethyl-6-tert-butyl-phenol, 2,6-di-tert-1-dimethylamino-p-cresol, 2,6-di-tert-4-(N,N'-di-methylaminomethylphenol),4,4'-thiobis(2-methyl-6-tert-butylphenol), 2,2'-thiobis(4-methyl-6-tert-butylphenol), bis(3-methyl-4-hydroxy-5-tert-10-butylbenzyl)-sulfide, and bis(3,5-di-tert-butyl-4-hydroxybenzyl). More preferred are hindered phenols and molybdenum-containing compounds that do not contribute to the phosphorus, sulfur and sulfated ash content of the lubricating oil, provided the molybdenum compounds do not include tri-nuclear molybdenum.

Examples of the preferred low and high overbased metal detergents that may be employed in the lubricating oil composition of the present invention are low and high overbased sulfonic acids or phenols or Mannich condensation products of alkylphenols, aldehydes and amines. More preferred are low and high overbased sulfonic acids. It is preferred that the overbased detergents do not include overbased salicylic acids or carboxylic acids. These detergents may be alkali metal detergents or alkaline earth metal detergents. Preferably they are alkaline earth metal detergents and more preferably they are calcium detergents. The TBN of these detergents is greater than 1 and about 500, or more.

Another embodiment of the present invention is directed to a low sulfur and low phosphorus heavy duty diesel engine lubricating oil composition comprising:

(a) a major amount of an oil of lubricating viscosity;

(b) a borated dispersant and a non-borated dispersant;

(c) a molybdenum-containing anti-oxidant and a phenolic anti-oxidants; and (d) a low overbased calcium sulfonate and a high overbased calcium phenate;

wherein the lubricating oil composition is essentially free of zinc di-alkyl di-thiophosphates and contains no more than 0.175 weight percent sulfur and provided the lubricating oil composition does not contain alkylated and non-alkylated aromatic amines and tri-nuclear molybdenum compounds.

In the lubricating oil composition of the above embodiment, preferably the concentration of the zinc di-alkyl di-thiophosphates is less than 0.2 weight percent based on the total weight of the lubricating oil composition. More preferably the concentration of the zinc di-alkyl di-thiophosphates is less than 0.1 weight percent based on the total weight of the lubricating oil composition, and most preferably the concentration of the zinc di-alkyl di-thiophosphates is less than 0.0 based on the total weight of the lubricating oil composition.

Preferably the sulfur content of the lubricating oil composition of the above embodiment is in the range of 0.0 weight percent to about 0.17 weight percent based on the total weight of the lubricating oil composition. More preferably the sulfur content of the lubricating oil composition of the present invention is in the range of 0.06 weight percent to about 0.165 weight percent based on the total weight of the lubricating oil composition. Most preferably the sulfur content of the lubricating oil composition of the present invention is in the range of 0.08 weight percent to about 0.16 weight percent based on the total weight of the lubricating oil composition.

Preferably the phosphorus content of the lubricating oil composition of the above embodiment is in the range of 0.0 weight percent to about 0.03 weight percent based on the total weight of the lubricating oil composition. More preferably the phosphorus content of the lubricating oil composition of the present invention is in the range of 0.0 weight percent to about 0.02 weight percent based on the total weight of the lubricating oil composition. Even more preferably the phosphorus content of the lubricating oil composition of the present invention is in the range of 0.0 weight percent to about 0.01 weight percent based on the total weight of the lubricating oil composition and most preferably it is 0.0.

A further embodiment of the present invention is directed to a low sulfur and low phosphorus heavy duty diesel engine lubricating oil composition consisting essentially of:

(a) a major amount of an oil of lubricating viscosity;

(b) one or more dispersants;

(c) one or more anti-oxidants;

(d) one or more ash-containing detergents; and (e) one or more additives selected from one or more dispersants different from those recited in (b), anti-oxidants different from those recited in (c), detergents different from those recited in (d), viscosity index improvers, ashless sulfur extreme pressure agents, alkaline earth metal and alkali metal borated extreme pressure agents, molybdenum-containing extreme pressure agents, pour point depressants, rust inhibitors, corrosion inhibitors, ash-containing friction modifiers, ashless friction modifiers, molybdenum-containing friction modifiers, metal deactivators, seal swell agents, demulsifiers and anti-foaming agents;

wherein the lubricating oil composition is essentially free of zinc di-alkyl di-thiophosphates and contains no more than 0.175 weight percent sulfur and provided the lubricating oil composition does not contain alkylated and non-alkylated aromatic amines and tri-nuclear molybdenum compounds.

Preferably the one or more detergents in (e) in the above lubricating oil composition is not an overbased metal salicylate or an overbased metal carboxylate.

Preferably the sulfur content of the lubricating oil composition of the above embodiment is in the range of 0.0 weight percent to about 0.17 weight percent based on the total weight of the lubricating oil composition. More preferably the sulfur content of the lubricating oil composition of the present invention is in the range of 0.06 weight percent to about 0.165 weight percent based on the total weight of the lubricating oil composition. Most preferably the sulfur content of the lubricating oil composition of the present invention is in the range of 0.08 weight percent to about 0.16 weight percent based on the total weight of the lubricating oil composition.

Preferably the phosphorus content of the lubricating oil composition of the above embodiment is in the range of 0.0 weight percent to about 0.03 weight percent based on the total weight of the lubricating oil composition. More preferably the phosphorus content of the lubricating oil composition of the present invention is in the range of 0.0 weight percent to about 0.02 weight percent based on the total weight of the lubricating oil composition. Even more preferably the phosphorus content of the lubricating oil composition of the present invention is in the range of 0.0 weight percent to about 0.01 weight percent based on the total weight of the lubricating oil composition and most preferably it is 0.0.

The lubricating oil composition of the above embodiment may also contain viscosity index improvers such as olefin copolymers, examples of which are ethylene-propylene copolymers, styrene-isoprene copolymers, hydrated styrene-isoprene copolymers, polybutene, polyisobutylene, polymethacrylates, vinylpyrrolidone and methacrylate copolymers and dispersant type viscosity index improvers.

Pour point depressants lower the temperature at which the fluid will flow or can be poured. Additives that optimize the low temperature fluidity of the lubricating oil are various copolymers, such as polymethacrylates.

The addition of rust inhibitors to the lubricating oil composition of the present invention is also contemplated. Preferred Rust inhibitors include nonionic polyoxyethylene surface active agents, such as polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol mono-oleate. Other compounds that may also be employed as rust inhibitors include stearic acid and other fatty acids, di-carboxylic acids, metal soaps, fatty acid amine salts, metal salts of heavy sulfonic acid, partial carboxylic acid ester of polyhydric alcohol, and phosphoric ester. However, the more preferred rust inhibitors are those that do not contribute to the phosphorus or sulfur content of the lubricating oil.

Friction modifiers employable in the lubricating oil composition of the present invention include both ash-containing as well as ashless friction modifiers. Friction modifiers include, but are not limited to, fatty alcohols, fatty acids, such as stearic acid, isostearic acid, oleic acid and other fatty acids or salts and esters thereof, borated esters, amines, phosphates, and di-, and tri-hydrocarbyl phosphates, hydrocarbyl phosphites and phosphonates. Friction modifiers may also contain molybdenum, provided the molybdenum compounds do not include tri-nuclear molybdenum. Preferably the friction modifiers used in the lubricating oil composition of the present invention are ashless friction modifiers.

Extreme pressure agents that may be used in the lubricating oil composition of the present invention include alkaline earth metal borated extreme pressure agents and alkali metal borated extreme pressure agents. Extreme pressure agents containing molybdenum may also be employed in the lubricating oil composition of the present invention, provided the molybdenum compounds do not include tri-nuclear molybdenum. Sulfurized olefins, zinc dialky-1-dithiophosphate (primary alkyl, secondary alkyl, and aryl type), di-phenyl sulfide, methyl tri-chlorostearate, chlorinated naphthalene, fluoroalkylpolysiloxane, lead naphthenate, neutralized or partially neutralized phosphates, di-thiophosphates, and sulfur-free phosphates. The preferred extreme pressure agents are those that will not contribute to the phosphorus content of the lubricating oil.

Preferred corrosion inhibitors contemplated for use in the lubricating oil of the present invention may be derivatives of di-phenyl amine, derivatives of succinimides, sulfurized olefin and the co-sulfurized alkenyl ester/alpha olefin corrosion inhibitor. The corrosion inhibitors such as metal di-thiophosphates, especially zinc di-alkyl di-thiophosphate, are less desirable because they may contribute to the zinc, phosphorus and sulfur content of the lubricating oil. More preferred corrosion inhibitors are the derivatives of succinimides.

Metal deactivators that are employable in the lubricating oil of the present invention include di-salicylidene propylenediamine, triazole derivatives, mercaptobenzothiazoles, thiodiazole derivatives, and mercaptobenzimidazoles.

The lubricating oil composition of the present invention may employ seal swell agents, including but are not limited to, di-esters such as di-2-ehtylhexylsebacate, di-octyladipate and di-2-ethylhexylphthalate, mineral oils with aliphatic alcohols, such as tri-decyl alcohol and Trisphosphite ester in combination with a hydrocarbonyl-substituted phenol.

Demulsifiers that may be included in the lubricating oil of the present invention include, but are not limited to, are addition product of alkylphenol and ethylene oxide, polyoxyethylene alkyl ether, and polyoxyethylene sorbitan ester.

Useful foam inhibitors for the present invention are alkyl methacrylate.

Another embodiment of the present invention is directed to a low sulfur and low phosphorus heavy duty diesel engine lubricating oil composition consisting essentially of:

(a) a major amount of an oil of lubricating viscosity;
(b) a borated dispersant and a non-borated dispersant;
(c) a molybdenum-containing anti-oxidant and a phenolic anti-oxidants;
(d) a low overbased calcium sulfonate and a high overbased calcium phenate; and
(e) one or more additives selected from one or more dispersants different from those recited in (b), anti-oxidants different from those recited in (c), detergents different from those recited in (d), viscosity index improvers, ashless sulfur extreme pressure agents, alkaline earth metal and alkali metal borated extreme pressure agents, molybdenum-containing extreme pressure agents, pour point depressants, rust inhibitors, corrosion inhibitors, ash-containing friction modifiers, ashless friction modifiers, molybdenum-containing friction modifiers, metal deactivators, seal swell agents, demulsifiers, anti-foaming agents and anti-wear agents;

wherein the lubricating oil composition is essentially free of zinc di-alkyl di-thiophosphates and contains no more than 0.175 weight percent sulfur and provided the lubricating oil composition does not contain alkylated and non-alkylated aromatic amines and tri-nuclear molybdenum compounds Preferably the one or more detergents in (e) in the above lubricating oil composition is not an overbased metal salicylate or an overbased metal carboxylate.

Preferably the sulfur content of the lubricating oil composition of the above embodiment is in the range of 0.0 weight percent to about 0.17 weight percent based on the total weight of the lubricating oil composition. More preferably the sulfur content of the lubricating oil composition of the present invention is in the range of 0.06 weight percent to about 0.165 weight percent based on the total weight of the lubricating oil composition. Most preferably the sulfur content of the lubricating oil composition of the present invention is in the range of 0.08 weight percent to about 0.16 weight percent based on the total weight of the lubricating oil composition.

Preferably the phosphorus content of the lubricating oil composition of the above embodiment is in the range of 0.0 weight percent to about 0.03 weight percent based on the total weight of the lubricating oil composition. More preferably the phosphorus content of the lubricating oil composition of the present invention is in the range of 0.0 weight percent to about 0.02 weight percent based on the total weight of the lubricating oil composition. Even more preferably the phosphorus content of the lubricating oil composition of the present invention is in the range of 0.0 weight percent to about 0.01 weight percent based on the total weight of the lubricating oil composition and most preferably it is 0.0.

In a further embodiment of the present invention, the oil of lubricating viscosity is not a liquid polymer of alpha olefins.

Another embodiment of the above embodiment is directed to a low sulfur and low phosphorus heavy duty diesel engine lubricating oil concentrate comprising:

(a) a major amount of an oil of lubricating viscosity;
(b) one or more dispersants;
(c) one or more anti-oxidants; and
(d) one or more ash-containing detergents;

wherein the lubricating oil composition is essentially free of zinc di-alkyl di-thiophosphates and contains no more than 0.175 weight percent sulfur and provided the lubricating oil composition does not contain alkylated and non-alkylated aromatic amines and tri-nuclear molybdenum compounds.

Preferably the one or more detergents in (d) in the above lubricating oil concentrate is not an overbased metal salicylate or an overbased metal carboxylate.

Another embodiment of the present invention is directed to a low sulfur and low phosphorus heavy duty diesel engine lubricating oil concentrate consisting essentially of:

(a) a major amount of an oil of lubricating viscosity;
(b) a borated dispersant and a non-borated dispersant;

(c) a molybdenum-containing anti-oxidant and a phenolic anti-oxidants;

(d) a low overbased calcium sulfonate and a high overbased calcium phenate; and (e) one or more additives selected from one or more dispersants different from those recited in (b), anti-oxidants different from those recited in (c), detergents different from those recited in (d), viscosity index improvers, ashless sulfur extreme pressure agents, alkaline earth metal and alkali metal borated extreme pressure agents, molybdenum-containing extreme pressure agents, pour point depressants, rust inhibitors, corrosion inhibitors, ash-containing friction modifiers, ashless friction modifiers, molybdenum-containing friction modifiers, metal deactivators, seal swell agents, demulsifiers, anti-foaming agents and anti-wear agents;

wherein the lubricating oil composition is essentially free of zinc di-alkyl di-thiophosphates and contains no more than 0.175 weight percent sulfur and provided the lubricating oil composition does not contain alkylated and non-alkylated aromatic amines and tri-nuclear molybdenum compounds.

Preferably the one or more detergents in (e) in the above lubricating oil concentrate is not an overbased metal salicylate or an overbased metal carboxylate.

A further embodiment of the present invention is directed to a method for lubricating heavy duty diesel engines, which comprises lubricating the engine with a low sulfur and low phosphorus heavy duty diesel engine lubricating oil composition comprising:

(a) a major amount of an oil of lubricating viscosity;

(b) one or more dispersants;

(c) one or more anti-oxidants;

(d) one or more ash-containing detergents; and wherein the lubricating oil composition is essentially free of zinc di-alkyl di-thiophosphates and contains no more than 0.175 weight percent sulfur and provided the lubricating oil composition does not contain alkylated and non-alkylated aromatic amines and tri-nuclear molybdenum compounds.

Preferably the one or more detergents in (d) in the above lubricating oil composition is not an overbased metal salicylate or an overbased metal carboxylate.

Another embodiment of the present invention is directed to a method for lubricating heavy duty diesel engines, which comprises lubricating the engine with a low sulfur and low phosphorus heavy duty diesel engine lubricating oil composition consisting essentially of:

(a) a major amount of an oil of lubricating viscosity;

(b) a borated dispersant and a non-borated dispersant;

(c) a molybdenum-containing anti-oxidant and a phenolic anti-oxidants;

(d) a low overbased calcium sulfonate and a high overbased calcium phenate; and (e) one or more additives selected from one or more dispersants different from those recited in (b), anti-oxidants different from those recited in (c), detergents different from those recited in (d), viscosity index improvers, ashless sulfur extreme pressure agents, alkaline earth metal and alkali metal borated extreme pressure agents, molybdenum-containing extreme pressure agents, pour point depressants, rust inhibitors, corrosion inhibitors, ash-containing friction modifiers, ashless friction modifiers, molybdenum-containing friction modifiers, metal deactivators, seal swell agents, demulsifiers, anti-foaming agents and anti-wear agents;

wherein the lubricating oil composition is essentially free of zinc di-alkyl di-thiophosphates and contains no more than 0.175 weight percent sulfur and provided the lubricating oil composition does not contain alkylated and non-alkylated aromatic amines and tri-nuclear molybdenum compounds.

Preferably the one or more detergents in (e) in the above lubricating oil composition is not an overbased metal salicylate or an overbased metal carboxylate.

DETAILED DISCRIPTION OF THE INVENTION

Definitions

As used herein, the following terms have the following meanings unless expressly stated to the contrary:

The term "alkali metal" as used herein refers to Group IA metals of the Periodic Table.

The term "alkaline earth metal" as used herein refers to Group II metals of the Periodic Table, such as calcium and magnesium.

The term "essentially free" as used herein refers to the zinc di-alkyl di-thiophosphate content in the lubricating oil composition of the present invention. Preferably zinc di-alkyl di-thiophosphate content in the lubricating oil composition is less than 0.2 weight percent based on the total weight of the lubricating oil composition. More preferably the zinc di-alkyl di-thiophosphate content in the lubricating oil composition is less than 0.1 weight percent based on the total weight of the lubricating oil composition. Even more preferably the zinc di-alkyl di-thiophosphate content in the lubricating oil composition is less than 0.005 weight percent based on the total weight of the lubricating oil composition. Most preferably the zinc di-alkyl di-thiophosphate content in the lubricating oil composition is less than 0.0 weight percent based on the total weight of the lubricating oil composition.

The term "low phosphorus" as used herein refers to the phosphorus content of the lubricating oil. The phosphorus content of the lubricating oil is preferably in the range from about 0.0 weight percent to about 0.03 weight percent based on the total weight of the lubricating oil. More preferably the phosphorus content of the lubricating oil is in the range from about 0.0 weight percent to about 0.02 weight percent based on the total weight of the lubricating oil. Even more preferably the phosphorus content of the lubricating oil is in the range from about 0.0 weight percent to about 0.01 weight percent based on the total weight of the lubricating oil. Most preferably the phosphorus content of the lubricating oil is 0.0 weight percent based on the total weight of the lubricating oil.

The term "low sulfur" as used herein refers to the sulfur content of the lubricating oil. The sulfur content of the lubricating oil is no more than 0.175 weight percent based on the total weight of the lubricating oil composition. Preferably the sulfur content is in the range from about 0.06 weight percent to about 0.165 weight percent based on the total weight of the lubricating oil. More preferably the sulfur content of the lubricating oil is in the range from about 0.08 weight percent to about 0.16 weight percent based on the total weight of the lubricating oil.

The term "overbased" as used herein refers to alkaline earth metal alkylphenols, and alkyl sulfonates in which the ratio of the number of equivalents of an alkaline earth metal to the number of equivalents of the organic moiety is greater than 1. Low overbased refers to alkaline earth metal alkylphenols, alkyl salicylates and alkyl sulfonates having a Total Base Number (TBN) greater than 1 and less than 20, medium overbased refers to alkaline earth metal alkylphenols and alkyl sulfonates having a TBN greater than 20 and less than 200. High overbased refers to alkaline earth metal alkylphenols and alkyl sulfonates having a TBN greater than 200.

The term "sulfated ash" as used herein refers to the non-combustible residue resulting from detergents and metallic additives in lubricating oil. Sulfated ash was determined using ASTM Test D874.

The term "Total Base Number" or "TBN" as used herein refers to the amount of base equivalent to milligrams of KOH in one gram of sample. Thus, higher TBN numbers reflect more alkaline products, and therefore a greater alkalinity. TBN was determined using ASTM D 2896 test.

Unless otherwise specified, all percentages are in weight percent.

Lubricating Oil Composition

It has been discovered that the a low sulfur and low phosphorus lubricating oil composition comprising an liner wear protection additive composition comprising a metal salt of a Mannich condensation product provides good wear control when used for heavy duty diesel engines. Wear control in conventional lubricating oil compositions is achieved by the addition of metal salts of di-alkyl di-thiophosphates, for example zinc di-alkyl di-thiophosphates, however, the metal in these liner wear protection additives contributes to an increase in sulfated ash in the lubricating oil and the phosphorus causes inactivation of oxidation catalysts used in exhaust after-treatment devices. The liner wear protection additive composition employed in the lubrication oil composition of the present invention provides good wear control without contributing to an increase in sulfur and sulfated ash, and because it contains little or no phosphorus, it does not inactivate the oxidation catalysts.

The lubricating oil composition of the present invention may be prepared by simple blending or mixing of the compounds described in more detail below. These compounds may also be preblended as a concentrate or package with various other additives in appropriate ratios to facilitate blending of a lubricating oil composition containing the desired concentration of additives.

Oil of Lubricating Viscosity

Oil of lubricating viscosity, or base oil as used herein refer to lubricating oils which may be mineral oil or synthetic oils of lubricating viscosity and preferably useful in the crankcase of an internal combustion engine. Crankcase lubricating oils ordinarily have a viscosity of about 1300 centistokes at −17.8° C. to 22.7 centistokes at 98.9° C. The lubricating oils may be derived from synthetic or natural sources. Mineral oil for use as the base oil in this invention includes paraffinic, naphthenic and other oils that are ordinarily used in lubricating oil compositions. Synthetic oils include hydrocarbon synthetic oils and synthetic esters. Useful synthetic hydrocarbon oils include liquid polymers of alpha-olefins having the proper viscosity. Especially useful are the hydrogenated liquid oligomers of $C_6$ to $C_{12}$ alpha-olefins such as 1-decene trimer. Similarly, alkyl benzenes of proper viscosity, such as didodecyl benzene, may be used. Useful synthetic esters include the esters of both mono-carboxylic acids and polycarboxylic acids as well as mono-hydroxy alkanols and polyols. Typical examples are didodecyl adipate, pentaerthritol tetracapoate, di-2-ethylhexyl adipate, di-laurylsebacate and the like. Complex esters prepared from mixtures of mono- and di-carboxylic acid and mono- and di-hydroxy alkanols can also be used. Blends of hydrocarbon oils and synthetic oils may also be used. For example, blends of 10 weight percent to 25 weight percent hydrogenated 1-decene trimer with 75 weight percent to 90 weight percent 683 centistokes at 37.8° C. mineral oil gives an excellent oil base. Fischer-Tropsch derived base oils may also be employed in the lubricating oil composition of the present invention.

It is further contemplated that the oil of lubricating viscosity employed for preparing the lubricating oil composition of the present invention is a low sulfur base oil. Use of a low sulfur base oil assists in obtaining a lubricating oil composition which is ultra low in sulfur content. Sulfur content of base oils is well known by persons skilled in the art, thus, selection of a low sulfur base oil may be conveniently made for the purpose of the present invention.

Dispersants

The lubricating oil composition of the present invention contains dispersants. Typically, the ashless dispersants are nitrogen-containing dispersants formed by reacting alkenyl succinic acid anhydride with an amine. Examples of such dispersants are alkenyl succinimides and succinamides. These dispersants can be further modified by reaction with, for example, boron or ethylene carbonate. Ester-based ashless dispersants derived from long chain hydrocarbon-substituted carboxylic acids and hydroxy compounds may also be employed. Preferred ashless dispersants are those derived from polyisobutenyl succinic anhydride. A large number of dispersants are commercially available.

Anti-oxidants

Anti-oxidants are used in lubricating oils for inhibition of decomposition processes that occur naturally in lubricating oils as they age or oxidize in the presence of air. These oxidation processes may cause formation of gums, lacquers and sludge resulting in an increase in acidity and viscosity. Examples of useful anti-oxidants are hindered phenol oxidation inhibitors, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butylphenol), 4,4'-butylidene-bis(3-methyl-6-tert-butylphenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-5-methylene-bis(4-methyl-6-cyclohexylphenol), 2,6-di-tert-butyl-4-methylphenol, 2,6-di-tert-butyl-4-ethylphenol, 2,4-dimethyl-6-tert-butyl-phenol, 2,6-di-tert-1-dimethylamino-p-cresol, 2,6-di-tert4-(N,N'-di-methylaminomethylphenol), 4,4'-thiobis(2-methyl-6-tert-butylphenol), 2,2'-thiobis(4-methyl-6-tert-butylphenol), bis(3-methyl-4-hydroxy-5-tert-10-butylbenzyl)-sulfide, and bis(3,5-di-tert-butyl4-hydroxybenzyl). Examples of alkylated and non-alkylated aromatic amines are alkylated diphenylamine, phenyl-alpha-naphthylamine, and alkylated-alpha-naphthylamine. Other classes of anti-oxidants are esters of thiodicarboxylic acids, salts of di-thiophosphoric acids, alkyl or aryl phosphates and molybdenum compounds, such as amine-molybdenum complex compound and molybdenum di-thiocarbamates may also be used as anti-oxidants, provided the molybdenum compounds do not include tri-nuclear molybdenum. However, their addition of the will contribute to the phosphorus, sulfur and sulfated ash content of the lubricating oil.

Low, Medium and High Overbased Metal Detergents

Examples of the low and medium overbased metal detergents employed in the lubricating oil composition of the present invention are low or medium overbased sulfonic acids, phenols or Mannich condensation products of alkylphenols, aldehydes and amines. It is preferred that the overbased detergents do not include overbased salicylic acids or carboxylic acids. These detergents may be alkali metal detergents or alkaline earth metal detergents. Preferably they are alkaline earth metal detergents and more preferably they are calcium detergents. The TBN of these detergents is greater than 1 and about 500, or more. These detergents are well known in the art and are commercially available.

Other Additives

The lubricating oil composition of the present invention may also typically contain, in addition to the additives discussed above, other additives used to impart desirable properties to the lubricating oil composition of the present invention. Thus, the lubricating oil may contain one or more of additives, such as viscosity index improvers, pour point depressants, demulsifiers, extreme pressure anti-wear agents and foam inhibitors.

Viscosity Index Improvers

Viscosity index improvers are added to lubricating oil to regulate viscosity changes due to the change in temperature. Some commercially available examples of viscosity index improvers are olefin copolymers, such as ethylene-propylene copolymers, styrene-isoprene copolymers, hydrated styrene-isoprene copolymers, polybutene, polyisobutylene, polymethacrylates, vinylpyrrolidone and methacrylate copolymers and dispersant type viscosity index improvers.

Extreme Pressure Agents

Extreme pressure agents that may be used in the lubricating oil composition of the present invention include alkaline earth metal borated extreme pressure agents and alkali metal borated extreme pressure agents. Extreme pressure agents containing molybdenum may also be employed in the lubricating oil composition of the present invention, provided the molybdenum compounds do not include tri-nuclear molybdenum. Sulfurized olefins, zinc dialky-1-dithiophosphate (primary alkyl, secondary alkyl, and aryl type), di-phenyl sulfide, methyl tri-chlorostearate, chlorinated naphthalene, fluoroalkylpolysiloxane, lead naphthenate, neutralized or partially neutralized phosphates, di-thiophosphates, and sulfur-free phosphates. The preferred extreme pressure agents are those that will not contribute to the phosphorus content of the lubricating oil.

Pour Point Depressants

Polymethyl methacrylate is an example of a pour point depressant useful for addition to the lubricating oil of the present invention.

Rust Inhibitors

Rust inhibitors include nonionic polyoxyethylene surface active agents, such as polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol monooleate, and polyethylene glycol mono-oleate. Other compounds that may also be employed as rust inhibitors include stearic acid and other fatty acids, di-carboxylic acids, metal soaps, fatty acid amine salts, metal salts of heavy sulfonic acid, partial carboxylic acid ester of polyhydric alcohol, and phosphoric ester. However, preferred rust inhibitors are those that do not contribute to the phosphorus or sulfur content of the lubricating oil.

Corrosion Inhibitors

Corrosion inhibitors are included in lubricating oils to protect vulnerable metal surfaces. Such corrosion inhibitors are generally used in very small amounts in the range of from about 0.02 weight percent to about 1.0 weight percent. Examples of corrosion inhibitors that may be used are sulfurized olefin corrosion inhibitor and the co-sulfurized alkenyl ester/alpha olefin corrosion inhibitor. The corrosion inhibitors should not be a metal di-thiophosphates, especially zinc di-alkyl di-thiophosphate because addition of this corrosion inhibitor will contribute to the zinc, phosphorus and sulfur content of the lubricating oil.

Friction Modifiers

Friction modifiers that are employable in the lubricating oil composition of the present invention include ash-containing as well as ashless friction modifiers. Friction modifiers include, but are not limited to, fatty alcohols, fatty acids, such as stearic acid, isostearic acid, oleic acid and other fatty acids or salts and esters thereof, borated esters, amines, phosphates, and di-, and tri-hydrocarbyl phosphates, hydrocarbyl phosphites and phosphonates. hydrocarbyl phosphites. Friction modifiers may also contain molybdenum, provided the molybdenum compounds do not include tri-nuclear molybdenum. Preferably the friction modifiers used in the lubricating oil composition of the present invention are ashless friction modifiers.

Metal Deactivators

Metal deactivators that may be employed in the lubricating oil composition of the present invention include but are not limited to di-salicylidene propylenediamine, triazole derivatives, mercaptobenzothiazoles, thiodiazole derivatives, and mercaptobenzimidazoles.

Seal Swell Agents

The lubricating oil composition of the present invention may employ seal swell agents, including but are not limited to, di-esters such as di-2-ehtylhexylsebacate, di-octyladipate and di-2-ethylhexylphthalate, mineral oils with aliphatic alcohols, such as tri-decyl alcohol and Trisphosphite ester in combination with a hydrocarbonyl-substituted phenol.

Demulsifiers

Demulsifiers that are employable in the lubricating oil of the present invention include but are not limited to addition product of alkylphenol and ethylene oxide, polyoxyethylene alkyl ether, and polyoxyethylene sorbitan ester.

Foam Inhibitors

Useful foam inhibitors for the present invention are alkyl methacrylate polymers, dimethyl silicone polymers and polysiloxane type foam inhibitors.

For best overall results in terms of affording the properties desired in a conventional lubricating oil composition for lubricating diesel engines, gasoline engines and natural gas engines, the lubricating oil may contain a compatible combination of additives of each of the above classes of additives in effective amounts.

The various additive materials or classes of materials herein described are well known materials and can be readily purchased commercially or prepared by known procedures or obvious modification thereof.

In Table I below are given treatment rates for additives contemplated for use in the lubricating oil of the present invention. All component amounts are given as a weight percent of the active additive.

TABLE I

| Component | Range (wt %) | Preferred Range (wt %) | Most Preferred Range (wt %) |
|---|---|---|---|
| Borated and non-borated Succinimide Dispersant | 0 to 10 | 2 to 9 | 2 to 7 |
| Anti-oxidants | 0 to 3.0 | 0.2 to 2.0 | 0.2 to 1.5 |
| Neutral or Metal Overbased Detergent | 0 to 10 | 1 to 8 | 1 to 5 |
| Viscosity Index Improvers | 0 to 10 | 2 to 9 | 3 to 8 |
| Extreme Pressure Agents | 0 to 2.0 | 0 to 1.0 | 0.1 to 0.5 |
| Pour Point Depressants | 0 to 1.0 | 0.05 to 0.5 | 0.05 to 0.3 |
| Rust Inhibitors | 0 to 1.0 | 0 to 0.75 | 0.05 to 0.5 |
| Corrosion Inhibitors | 0 to 3.0 | 0.2 to 2.0 | 0.2 to 1.5 |
| Friction Modifiers | 0 to 1.0 | 0.05 to 0.75 | 0.1 to 0.5 |
| Foam Inhibitors | 0 to 3.0 | 0.2 to 2.0 | 0.2 to 1.5 |

EXAMPLES

The low sulfur and low phosphorus heavy duty diesel engine lubricating oil composition of the present invention was evaluated for its anti-wear performance in formulations prepared as described in Example 1 and Table I below.

Example 1

Comparative Formulations A and B and Test Formulation C contained two dispersants, two anti-oxidants, a low overbased calcium sulfonate and a high overbased calcium phenate, a corrosion inhibitor and an anti-foaming agent.

Base oil was used to make-up a 100 percent of each of Comparative Formulations A and B and Test Formulation C.

The anti-wear performance of Test Formulation C was compared with Comparative Formulations A and B which contained zinc di-alkyl di-thiophosphate in addition to the other components given above. The degree of wear control with Test Formulation C was determined as a reduction in cylinder liner wear compared with Comparative Formulations A and B.

Comparative Formulations A and B and Test Formulation C are described in more detail in Table II below. The amounts of the components in the lubricating oil formulations are given in Table II in weight percent active additive.

TABLE II

| | Formulation (weight %) | | |
|---|---|---|---|
| Component | Comparative A | Comparative B | Test C |
| Base Oil | | | |
| Borated Dispersant | 1.0 | 1.0 | 1.0 |
| Non-borated Dispersant | 3.3 | 3.3 | 3.3 |
| Low Overbased Calcium Sulfonate | 0.4 | 0.4 | 0.4 |
| High Overbased Calcium Phenate | 2.5 | 2.5 | 2.5 |
| Molybdenum Anti-oxidant | 0.11 | 0.11 | 0.11 |
| Phenolic Anti-oxidant | 0.4 | 0.4 | 0.4 |
| Corrosion Inhibitor | 0.12 | 0.12 | 0.12 |
| Foam Inhibitor | 0.02 | 0.02 | 0.02 |
| Zinc Di-alkyl Di-thiophosphate | 1.4 | 0.5 | 0.0 |

Table III below shows the amount of the sulfur and phosphorus in Comparative Formulations A and B and Test Formulation C.

TABLE III

| | Formulation (weight %) | | |
|---|---|---|---|
| Component | Comparative A | Comparative B | Test C |
| Sulfur | 0.48 | 0.27 | 0.16 |
| Phosphorus | 0.16 | 0.06 | 0.00 |

Example 2

Cylinder Liner Wear Test

The anti-wear control of Test Formulation C was compared to Comparative Formulations A and B as described below.

Wear measurements were performed in a Mack Diesel Engine, installed in an engine test laboratory. The engine stand configuration was in conformance to the Mack T-10 engine test procedure known as ASTM Test Method D-6987. In addition, the engine was equipped with radiated cylinder liners and a system to circulate the engine lubricant through an external reservoir. A detector was placed in the reservoir to count the gamma-rays from the oil being circulated past the detector. The increase in the gamma-ray count over a fixed period of time is a measure of the amount of metal weight loss from the radiated area, in this case the cylinder liner area around the top ring reversal point.

The data reported were measured cylinder liner wear at the end of the test. The results of the Cylinder Liner Wear Test are summarized in Table IV below.

TABLE IV

| Cylinder Liner | Formulation | | |
|---|---|---|---|
| Wear Test | A | B | C |
| Measured Wear (nanometers/hour) | 39.6 | 14.2 | 10.2 |

The results obtained in the Cylinder Liner Wear Test summarized above in Table IV show that the cylinder liner wear measured for Comparative Formulation A containing a zinc di-alkyl di-thiophosphate was 36.9 nanometers per hour, while the liner wear measured for Test Formulation C containing no zinc di-alkyl di-thiophosphate was 10.2 nanometers per hour. The data show that leaving out the zinc di-alkyl di-thiophosphate from Test Formulation C gave a 74 percent reduction in cylinder liner wear compared to the cylinder liner wear observed with Comparative Formulation A containing a zinc di-alkyl di-thiophosphate. Similarly, the cylinder liner wear measured for Comparative Formulation B containing zinc di-alkyl di-thiophosphate was higher than that observed for Test Formulation C containing no zinc di-alkyl di-thiophosphate, but less than that observed for Comparative formulation A containing 3 times the amount of the zinc di-alkyl di-thiophosphate. A 64 percent reduction in cylinder liner wear was observed for Test Formulation C compared to Comparative Formulation B.

The results of the Cylinder Liner Wear Test summarized in Table IV above shows that Test Formulation C without zinc di-alkyl di-thiophosphate performed significantly better than Comparative Formulations A and somewhat better than Comparative Formulation B which contained zinc di-alkyl di-thiophosphate. This result was unexpected since zinc di-alkyl di-thiophosphate is a conventionally used anti-wear additive in heavy duty diesel engine lubricating oil. Based on conventional wisdom, this was a surprising result.

What is claimed:

1. A low sulfur and low phosphorus heavy duty diesel engine lubricating oil composition comprising:

(a) a major amount of an oil of lubricating viscosity;

(b) a borated dispersant and a non-borated dispersant;

(c) a molybdenum-containing anti-oxidant and a phenolic anti-oxidant; and (d) a low overbased calcium sulfonate and a high overbased calcium phenate;

wherein the lubricating oil composition is essentially free of zinc di-alkyl di-thiophosphates and contains no more than 0.175 weight percent sulfur and provided the lubricating oil composition does not contain alkylated and non-alkylated aromatic amines and tri-nuclear molybdenum compounds.

2. The lubricating oil composition of claim 1, wherein the concentration of the zinc di-alkyl di-thiophosphates in the lubricating oil composition is less than 0.2 weight percent based on the total weight of the lubricating oil composition.

3. The lubricating oil composition of claim 2, wherein the concentration of the zinc di-alkyl di-thiophosphates in the lubricating oil composition is less than 0.1 weight percent based on the total weight of the lubricating oil composition.

4. The lubricating oil composition of claim 3, wherein the concentration of the zinc di-alkyl di-thiophosphates in the lubricating oil composition is 0.0 weight percent based on the total weight of the lubricating oil composition.

5. The lubricating oil composition of claim 1, wherein the sulfur content is in the range of 0.0 weight percent to about 0.17 weight percent based on the total weight of the lubricating oil composition.

6. The lubricating oil composition of claim 5, wherein the sulfur content is in the range of 0.06 weight percent to about 0.165 weight percent based on the total weight of the lubricating oil composition.

7. The lubricating oil composition of claim 6, wherein the sulfur content is in the range of 0.08 weight percent to about 0.16 weight percent based on the total weight of the lubricating oil composition.

8. The lubricating oil composition of claim 1, wherein the phosphorus content is in the range Of 0.0 weight percent to about 0.03 weight percent based on the total weight of the lubricating oil composition.

9. The lubricating oil composition of claim 8, wherein the phosphorus content is in the range of 0.0 weight percent to about 0.02 weight percent based on the total weight of the lubricating oil composition.

10. The lubricating oil composition of claim 9, wherein the phosphorus content is in the range of 0.0 weight percent to about 0.01 weight percent based on the total weight of the lubricating oil composition.

11. The lubricating oil composition of claim 10, wherein the phosphorus content is 0.0 weight percent based on the total weight of the lubricating oil composition.

12. A low sulfur and low phosphorus heavy duty diesel engine lubricating oil composition consisting essentially of:

(a) a major amount of an oil of lubricating viscosity;

(b) a borated dispersant and a non-borated dispersant;

(c) a molybdenum-containing anti-oxidant and a phenolic anti-oxidant;

(d) a low overbased calcium, sulfonate and a high overbased calcium phenate; and (e) one or more additives selected from one or more dispersants different from those recited in (b), anti-oxidants different from those recited in (c), detergents different from those recited in (d), viscosity index improvers, ashless sulfur extreme pressure agents, alkaline earth metal and alkali metal borated extreme pressure agents, molybdenum-containing extreme pressure agents, pour point depressants, rust inhibitors, corrosion inhibitors, ash-containing friction modifiers, ashless friction modifiers, molybdenum-containing friction modifiers, metal deactivators, seal swell agents, demulsifiers and anti-foaming agents;

wherein the lubricating oil composition is essentially free of zinc di-alkyl di-thiophosphates and contains no more than 0.175 weight percent sulfur and provided the lubricating oil composition does not contain alkylated and non-alkylated aromatic amines and tri-nuclear molybdenum compounds.

13. The lubricating oil composition of claim 12, wherein the concentration of the zinc di-alkyl di-thiophosphates in the lubricating oil composition is less than 0.2 weight percent based on the total weight of the lubricating oil composition.

14. The lubricating oil composition of claim 13, wherein the concentration of the zinc di-alkyl di-thiophosphates in the lubricating oil composition is less than 0.1 weight percent based on the total weight of the lubricating oil composition.

15. The lubricating oil composition of claim 14, wherein the concentration of the zinc di-alkyl di-thiophosphates in the lubricating oil composition is 0.0 weight percent based on the total weight of the lubricating oil composition.

16. The lubricating oil composition of claim 12, wherein the sulfur content is in the range of 0.0 weight percent to about 0.17 weight percent based on the total weight of the lubricating, oil.

17. The lubricating oil composition of claim 16, wherein the sulfur content is in the range of 0.06 weight percent to about 0.165 weight percent based on the total weight of the lubricating oil composition.

18. The lubricating oil composition of claim 17, wherein the sulfur content is in the range of 0.08 weight percent to about 0.16 weight percent based on the total weight of the lubricating oil composition.

19. The lubricating oil composition of claim 12, wherein the phosphorus content is in the range of 0.0 weight percent to about 0.03 weight percent based on the total weight of the lubricating oil composition.

20. The lubricating oil composition of claim 19, wherein the phosphorus content is in the range of 0.0 weight percent to about 0.02 weight percent based on the total weight of the lubricating oil composition.

21. The lubricating oil composition of claim 20, wherein the phosphorus content is in the range of 0.0 weight percent to about 0.01 weight percent based on the total weight of the lubricating oil composition.

22. The lubricating oil composition of claim 21, wherein the phosphorus content is 0.0 weight percent based on the total weight of the lubricating oil composition.

23. The lubricating oil composition of claim 12, wherein the one or more detergents in (e) is not an overbased metal salicylate or an overbased metal carboxylate.

24. A low sulfur and low phosphorus heavy duty diesel engine lubricating oil concentrate consisting essentially of:

(a) a major amount of an oil of lubricating viscosity;

(b) a borated dispersant and a non-borated dispersant;

(c) a molybdenum-containing anti-oxidant and a phenolic anti-oxidant;

(d) a low overbased calcium sulfonate and a high overbased calcium phenate; and (e) one or more additives selected from one or more dispersants, provided they are different from those recited in (b), anti-oxidants, provided they are different from those recited in (c), detergents, provided they are different from those recited in (d), viscosity index improvers, ashless sulfur extreme pressure agents, alkaline earth metal and alkali metal borated extreme pressure agents, molybdenum-containing extreme pressure agents, pour point depressants, rust inhibitors, corrosion inhibitors, ash-containing friction modifiers, ashless friction modifiers, molybdenum-containing friction modifiers, metal deactivators, seal swell agents, demulsifiers and anti-foaming agents;

wherein the lubricating oil composition is essentially free of zinc di-alkyl di-thiophosphates and contains no more than 0.175 weight percent sulfur and provided the lubricating oil composition does not contain alkylated and non-alkylated aromatic amines and tri-nuclear molybdenum compounds.

25. The lubricating oil composition of claim 24, wherein the one or more detergents in (e) is not an overbased metal salicylate or an overbased metal carboxylate.

26. A method for lubricating heavy duty diesel engines, which comprises lubricating the engine with a low sulfur and low phosphorus heavy duty diesel engine lubricating oil composition consisting essentially of:

(a) a major amount of an oil of lubricating viscosity;

(b) a borated dispersant and a non-borated dispersant;

(c) a molybdenum-containing antioxidant and a phenolic anti-oxidant;

(d) a low overbased calcium sulfonate a high overbased calcium phenate; and (e) one or more additives selected from one or more dispersants different from those recited in (b), anti-oxidants different from those recited in (c), detergents different from those recited in (d), viscosity index improvers, ashless sulfur extreme pressure agents, alkaline earth metal and alkali metal borated extreme pressure agents, molybdenum-containing extreme pressure agents, pour point depressants, rust inhibitors, corrosion inhibitors, ash-containing friction modifiers, ashless friction modifiers, molybdenum-containing friction modifiers, metal deactivators, seal swell agents; demulsifiers and anti-foaming agents;

wherein the lubricating oil composition is essentially free of zinc di-alkyl di-thiophosphates and contains no more than 0.175 weight percent sulfur and provided the lubricating oil composition does not contain alkylated and non-alkylated aromatic amines and tri-nuclear molybdenum compound.

27. The lubricating oil composition of claim 18, wherein the one or more detergents in (e) is not an overbased metal salicylate or an overbased metal carboxylate.

* * * * *